United States Patent [19]

Geiser

[11] Patent Number: 4,470,588

[45] Date of Patent: Sep. 11, 1984

[54] SUCTION APPARATUS FOR OPENING FOLDED PAPER SHEETS OR THE LIKE

[75] Inventor: Peter Geiser, Winterthur, Switzerland

[73] Assignee: Grapha-Holding AG, Hergiswil, Switzerland

[21] Appl. No.: 489,232

[22] Filed: Apr. 27, 1983

[30] Foreign Application Priority Data

May 5, 1982 [CH] Switzerland ..... 27561/82

[51] Int. Cl.[3] ..... B65H 39/02

[52] U.S. Cl. ..... 270/55; 270/57

[58] Field of Search ..... 270/55–60, 270/53–54

[56] References Cited

U.S. PATENT DOCUMENTS

| | | | |
|---|---|---|---|
| 1,829,833 | 11/1931 | Kast | 270/55 |
| 2,025,527 | 12/1935 | Schramm | 270/55 |
| 2,159,987 | 5/1939 | Hartmann et al. | 270/55 |
| 2,461,573 | 2/1949 | Schwetzer | 270/55 |
| 3,127,163 | 3/1964 | Chambers et al. | 270/57 |
| 3,658,318 | 4/1972 | Bunting et al. | 270/55 |
| 3,661,379 | 5/1972 | Dolfini | 270/57 |

*Primary Examiner*—E. H. Eickholt

*Attorney, Agent, or Firm*—Peter K. Kontler

[57] ABSTRACT

Apparatus for opening folded paper sheets, each of which has a first and a second set of layers and each of which has an edge portion along which the layers are pivotable relative to each other, has a horizontal conveyor which transports each of a succession of folded sheets in such a way that the edge portion is located at the top and the layers extend downwardly. A group of suction heads, one for each layer of a set of layers, is adjacent to one side of the path of movement of successive folded sheets, and the suction heads orbit about axes which are inclined with respect to the vertical so that each suction head moves upwardly during that stage of each of its orbital movements when it approaches and attracts the respective layer and flexes it outwardly whereby the inner side of the layer can be intercepted by a stationary retaining element which follows the respective suction head. The foremost suction head flexes the outermost layer of a set of layers, the next suction head flexes the next-to-the outermost layer, and so forth.

17 Claims, 2 Drawing Figures

SUCTION APPARATUS FOR OPENING FOLDED PAPER SHEETS OR THE LIKE

BACKGROUND OF THE INVENTION

The present invention relates to improvements in apparatus for opening or spreading folded sheets which consist of paper or the like. More particularly, the invention relates to improvements in apparatus for opening folded sheets in the form of signatures or the like, namely, groups of panels or layers having two sets of layers which are pivotable relative to each other along an edge portion of the multi-layer sheet, e.g., along the back of a signature.

It is already known to open folded multi-layer sheets of the above outlined character by resorting to a substantially horizontal transporting device which engages the edge portions of the folded sheets and advances the thus engaged sheets in an orientation such that the layers extend downwardly, i.e., that the layers can be spread apart or opened up by pivoting along the edge portion which is engaged and held by the transporting device. German Pat. No. 581,077 discloses an apparatus which embodies the just discussed transporting device and further employs suction generating elements alternating with retaining or spreading elements. The suction generating elements which are used in the apparatus of the German patent are small pipes which diverge from the path of the folded sheets as considered in the direction of travel of such sheets. One end portion of each pipe is immediately adjacent to the path of movement of folded sheets and the other end portion of each pipe is located behind the next-following retaining element. Each pipe has a plurality of suction ports. A drawback of the patented apparatus is that it can only be used for opening or spreading of folded sheets whose layers are relatively rigid, and also that the number of folded sheets which can be opened per unit of time is low so that the patented apparatus cannot be used in modern high-speed bookbinding, newspaper gathering or analogous machines.

German Pat. No. 1,945,501 discloses a modified apparatus for the opening of folded sheets which employs rotary suction generating elements disposed in pairs and at a level above the path of folded sheets. The layers are held in horizontal planes and spaced-apart portions of each layer are engaged and attracted by a pair of suction generating elements. The just discussed apparatus is bulky, complex and expensive.

OBJECTS AND SUMMARY OF THE INVENTION

An object of the invention is to provide a novel and improved apparatus which can properly open folded signatures irrespective of the thickness and/or other characteristics of the material of the layers, which can be used for the opening of large or small folded sheets, and which is capable of opening folded sheets at a frequency greatly exceeding the capability of conventional apparatus.

Another object of the invention is to provide the apparatus with novel and improved means for transporting folded sheets in the course of the opening operation, and to provide the apparatus with novel and improved means for opening successive sheets during travel with the transporting means.

An additional object of the invention is to provide the apparatus with novel and improved means for delivering sheets to the transporting means.

Still another object of the invention is to provide a novel and improved method of opening folded sheets at a high frequency and without defacing, creasing and/or otherwise damaging the layers of the sheets.

A further object of the invention is to provide an apparatus which can be used in existing production lines as a superior substitute for heretofore known opening or spreading apparatus.

Another object of the invention is to provide the apparatus with novel and improved means for moving the opening elements while the folded sheets are caused to advance therealong.

An additional object of the invention is to provide novel and improved means for synchronizing the movements of various mobile components of the above outlined apparatus.

Another object of the invention is to provide a highly reliable opening apparatus whose operation is less affected by changes in speed than that of heretofore known apparatus and which can open readily flexible as well as relatively stiff folded sheets with the same facility and with the same degree of reliability.

The invention is embodied in an apparatus for opening successive folded sheets (e.g., signatures) each of which has two sets of layers pivotable with reference to one another along an edge portion of the respective folded sheet (e.g., along the back of a signature). The apparatus comprises substantially horizontal transporting conveyor means which serves to engage the edge portions of successive folded sheets so that the two sets of layers of each folded sheet extend downwardly, and to advance the thus engaged folded sheets in a predetermined direction along a predetermined elongated path, and a plurality of suction heads, one for each layer of a set. The suction heads are adjacent to one side of the elongated path and are installed one after the other, as considered in the direction of travel of successive folded sheets, to engage successive layers of the respective set (namely, the set which is accessible from the one side of the path) and to move the engaged layers away from the remaining layers of the one set and from the layers of the other set. The apparatus further comprises a plurality of suitably oriented and preferably stationary retaining elements, one for each suction head and each disposed downstream of the respective suction head, as considered in the direction of advancement of folded sheets along the elongated path, to maintain the respective layer of the one set in opened position and to thus enable the next-following suction head to reach the corresponding layer of the one set. Thus, the rearmost suction head attracts the outermost layer of the one set of layers, and such outermost layer is then held in opened position by the respective retaining element, the next suction head engages and attracts the next-to-the-outermost layer of the one set and maintains such layer in open position until the layer is engaged by the respective retaining element, and so forth until the opening of one-half of the folded sheet is completed. The thus opened folded sheet can be transferred onto a substantially wedge-like member which is installed downstream of the elongated path and prevents closing of the opened folded sheets. The manner in which the opened folded sheets are removed from the wedge-like member and are advanced for further processing forms no part of the present invention.

The apparatus further comprises means for orbiting the suction heads about discrete axes so that each suction head orbits along an endless path a portion of which is adjacent to the one side of the elongated path. Such apparatus further comprises a suction generating device and means for connecting the suction heads with the suction generating device so that the suction heads can attract the adjacent layers while the respective suction heads advance along the aforementioned portions of their endless paths. The axes of the suction heads are preferably inclined to the vertical in such a way that the suction heads which orbit along the aforementioned portions of their endless paths move from a lower level to a higher level, i.e., nearer to the elongated path which is defined by the sheet transporting conveyor means.

The apparatus further comprises second conveyor means which is at least substantially aligned with and is located upstream of the transporting conveyor means, as considered in the direction of transport of folded sheets along the elongated path, to deliver successive folded sheets into the range of the transporting conveyor means, and means for supplying folded sheets to the second conveyor means including third conveyor means which defines an upwardly extending path and serves to deliver successive folded sheets to the second conveyor means in such a way that the edge portion of each folded sheet is located at the upper end of the folded sheet which moves along the upwardly extending path into the range of the second conveyor means. An aligning device is installed adjacent to the second conveyor means to engage and orient (if necessary) the edge portions of successive folded sheets which are supplied by the third conveyor means. Such apparatus preferably further comprises means for yieldably biasing successive folded sheets against the second conveyor means during advancement of such folded sheets with the second conveyor means and into the range of the transporting conveyor means. The biasing means can comprise at least one roller or an analogous rotary element and means for urging the rotary element against the folded sheet which is adjacent to the second conveyor means, i.e., which has reached the upper end of the upwardly extending path.

The apparatus also comprises means for driving the transporting conveyor means or the second conveyor means at a periodically varying speed and for driving the other of these conveyor means at a speed which matches the speed of the conveyor means that is driven at a periodically varying speed during transfer of folded sheets from the second to the transporting conveyor means. If the conveyor means which is driven at a periodically varying speed is the transporting conveyor means, the suction heads are orbited at a periodically varying speed in synchronism with the transporting conveyor means. The means for periodically varying the speed of the transfer conveyor means is designed to vary the speed of the transfer conveyor means between a maximum and a minimum value, and the aforementioned biasing means is designed to urge the folded sheets against the second conveyor means while the transporting conveyor means is driven at the aforementioned minimum speed.

The suction heads and the retaining elements are preferably mounted on a common table or an analogous support, and such table is preferably adjustable up and down toward and away from the elongated path which is defined by the transporting conveyor means. The latter can comprise two endless flexible elements defining an elongated gap wherein the edge portions of successive folded sheets advance along the elongated path.

Successive suction heads are angularly offset with reference to one another, and such suction heads are preferably orbited by a common drive means, e.g., by a main shaft which drives discrete bevel gear transmissions, one for each suction head.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
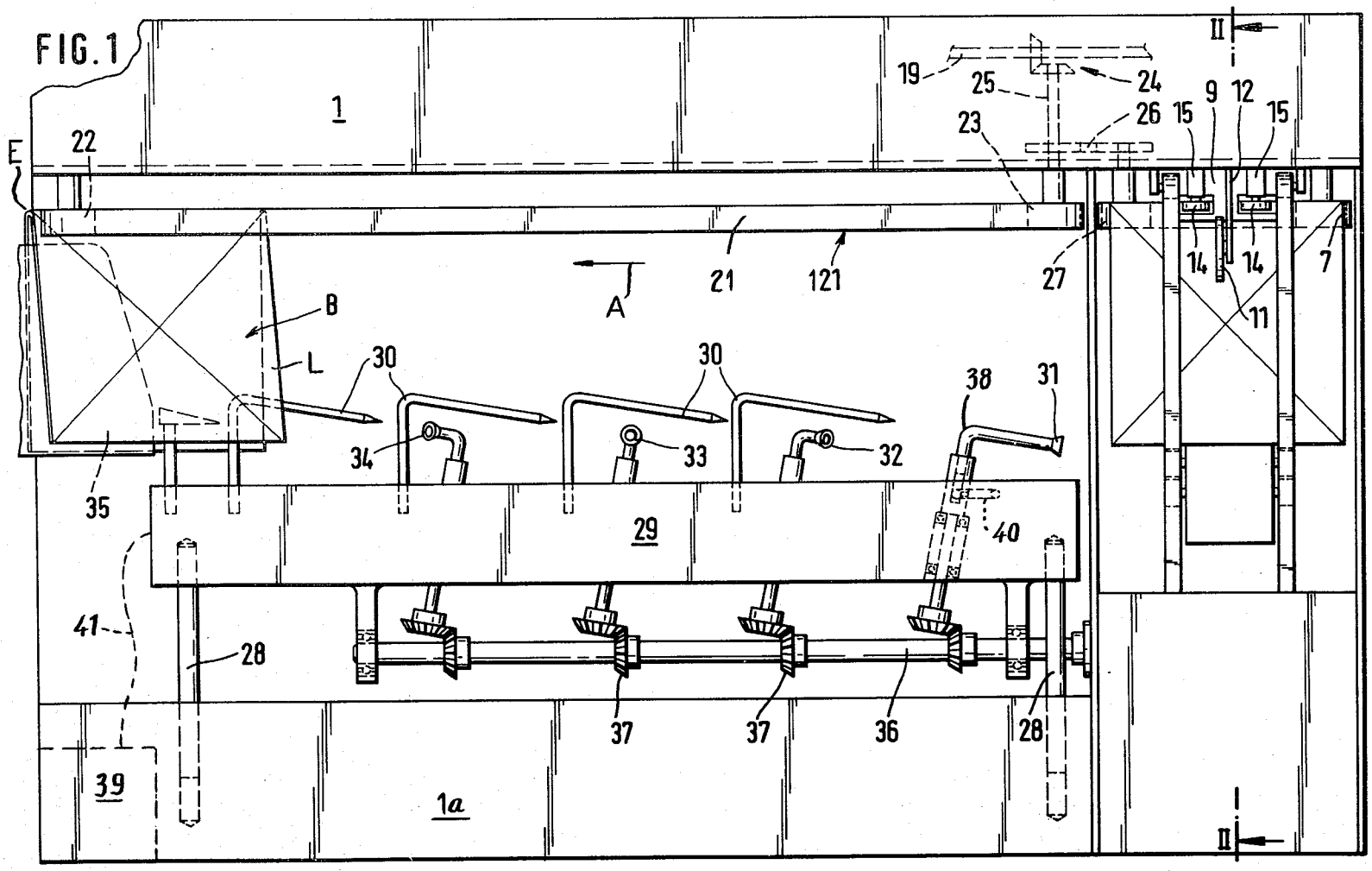
FIG. 1 is a side elevational view of an apparatus which embodies the present invention and has four suction heads.

The apparatus which is shown in the drawing comprises a housing or frame 1 supporting a conventional feeder 2 having a rotary drum-shaped transfer member 3 with gripper means 3*a* for removal of successive lowermost folded sheets B from a stack 4 which is confined in a magazine 4*a*. The gripper means 3*a* engages that edge portion E of each folded sheet B where the leaves of the folded sheet are pivotable with reference to one another. Each of the illustrated folded sheets B has two sets of leaves L, and each set comprises four leaves. The purpose of the improved apparatus is to open each folded sheet B so that a wedge-like member or saddle 35 (shown in the left-hand portion of FIG. 1) can enter the space between the two sets of leaves L.

The gripper means 3*a* of the transfer member 3 delivers successive folded sheets B into a gap between the neighboring reaches of two endless belt conveyors 5, 6 of a sheet supplying conveyor means serving to deliver successive sheets B into the range of a second or intermediate conveyor 7 behind a sheet transporting conveyor means 121 which latter transports the sheets B past the opening or spreading instrumentalities including orbiting suction heads 31, 32, 33, 34 and stationary retaining elements 30, one for each of the suction heads. It will be noted that the apparatus comprises a discrete suction head and a discrete retaining element for each layer or leaf L of a set of layers.

The conveyors 5, 6 are endless belt or band conveyors which are trained over a number of pulleys so as to define for successive folded sheets B an elongated path including a downwardly sloping portion immediately downstream of the transfer member 3, an arcuate portion which extends around a large pulley 56 common to both conveyors, and thereupon an upwardly extending portion wherein successive sheets B advance in such a way that the edge portion E is located at the upper end of the respective folded sheet.

The upwardly extending portion of the path which is defined by the conveyors 5, 6 is normal or substantially normal to the direction of transport of successive folded sheets B by the intermediate conveyor 7. The latter cooperates with an abutment or stop 9 which (if necessary) changes the orientation of the edge portions E of successive folded sheets B to ensure proper transport of folded sheets past the aforementioned opening instrumentalities. The abutment 9 can constitute a simple channel-shaped (grooved) strip which is immediately adjacent to and is located above the intermediate conveyor 7.

The apparatus further comprises entraining means for ensuring the delivery of the edge portion E of each folded sheet B into satisfactory engagement with the abutment 9 as well as for guaranteeing that the edge portions E remain in contact with the abutment 9 while advancing with the intermediate conveyor 7 toward and into the range of the sheet transporting conveyor means 121. Such entraining means comprises two rollers 10 and 11 which are urged toward each other. The roller 10 is nonrotatably secured to a horizontal shaft 8 which is driven by one of the pulleys for the belt conveyors 5, 6. The roller 11 is mounted at the lower end of a lever or arm 12 which is pivotably mounted in the frame 1, as at 12*a*, and is biased in a counterclockwise direction, as viewed in FIG. 2, by a coil spring, a torsion spring or the like (not specifically shown).

A two-armed lever 15 is mounted on a horizontal shaft 13. One arm of the lever 15 carries two rollers 14, and the other arm of this lever is connected with a coil spring 16 which tends to pivot the lever in a counterclockwise direction, as viewed in FIG. 2. The other arm of the lever 15 further carries a roller follower 17 which tracks the peripheral face of a disc cam 18 mounted on a timing shaft 19 of the apparatus. Still further, the one arm of the lever 15 carries a roller-shaped lifting or disengaging element 20 which can disengage the roller 11 from the roller 10 by acting upon the one-armed lever 12. The arrangement is such that the lever 15 causes its lifting element 20 to disengage the roller 11 from the roller 10 via lever 12 when the lever 15 causes the rollers 14 to bear against the intermediate conveyor 7 and more particularly against the edge portion E of a folded sheet B which is then disposed between the conveyor 7 and the rollers 14.

The conveyor 7 is a single endless belt conveyor one reach of which can cooperate with the rollers 14 to advance the edge portions E of successive folded sheets B into the gap between the inner reaches of two elongated horizontal belt conveyors 21 (only one shown) forming part of the aforementioned sheet transporting conveyor means 121. Each of the belt conveyors 21 is trained over two pulleys 22, 23 which are installed in the frame 1 at a level above the aforediscussed opening instrumentalities 30 and 31 to 34. The arrow A indicates the direction of movement of the inner reaches of the conveyors 21. The pulleys 23 for the conveyors 21 are driven by a bevel gear transmission 24 which receives motion from the timing shaft 19 so that the movements of the lever 15 under the action of the cam 18 (on the shaft 19) are synchronized with the movements of the belts 21. The output shaft 25 of the bevel gear transmission 24 drives the pulleys 23 at a constant speed. This shaft further transmits torque to a transmission 27 which drives one of the pulleys 27 for the belt of the intermediate conveyor 7. The transmission 26 is designed in such a way that the speed of the conveyor 7 fluctuates between a maximum speed and a minimum speed. The speed of the conveyor 7 is reduced to the minimum value when the lever 15 is caused to urge its rollers 14 toward the conveyor 7. The speed of the conveyor 7 is thereupon rigidly increased to match that of the conveyors 21. This ensures that, when the edge portion E of a folded sheet B is in the process of being taken over by the sheet transporting conveyor means 121, the speed of the intermediate conveyor 7 equals or closely approximates that of the conveyors 21. The transmission 26 can be of the type disclosed in U.S. Pat. No. 4,232,484 granted Nov. 28, 1980 to Buchmann. Such transmissions are known as swingable or oscillatable crank guide drives. For the sake of convenience, the disclosure of the patent to Buchmann is incorporated herein by reference. It will be understood, however, that any other transmission which can cyclically increase and reduce the speed of the intermediate conveyor 7 can be used with equal or similar advantage. Reference may also be had to Rohwolt's German-language "Lexikon der Technik" (Volume 2, page 278).

It is clear that the operation of the improved apparatus is just as satisfactory or nearly equally satisfactory if the transmission 24 drives the conveyor 7 at a constant speed and the transmission 26 drives the conveyors 21 at a speed which fluctuates between a maximum and a minimum value. In either event, the transmission or transmissions between the timing shaft 19 on the one hand and the conveyor 7, 21 on the other hand should ensure that the speed of the conveyors 21 matches or closely approximates the speed of the conveyor 7 when the conveyor 7 is in the process of delivering the edge portion E of a folded sheet B into the space between the receiving ends of the conveyors 21.

The frame 1 further carries a support 29 here shown as a table which is disposed at a level below the conveyors 21 and is movable up and down by adjusting means in the form of freed screws 28 rotatably mounted in the base 1*a* of the frame 1 and extending into tapped bores of the support 29. The latter carries the aforementioned spreading or opening instrumentalities including the four retaining elements 30 and the four suction heads 31 to 34.

The suction heads 31, 32, 33 and 34 are disposed one after the other, as considered in the direction (arrow A) of transport of successive folded sheets B between the inner reaches of the conveyors 21, and the retaining elements 30 are disposed behind the suction heads, as considered in such direction. The suction heads 31 to 34 orbit about parallel axes which are inclined to the vertical so that the endless path of each suction head has an arcuate portion which is adjacent to the respective side of the path of movement of folded sheets B with the conveyors 21. It will be noted that the angular position of the suction head 32 deviates from that of the suction head 31, that the angular position of the suction head 33 deviates from that of the suction head 32, and so forth. The arrangement is such that those portions of the endless paths of the suction heads 31 to 34 which are adjacent to the respective side of the elongated path for the folded sheets B between the conveyors 21 slope upwardly from a lower level to a higher level, as considered in the direction of rotation of the suction heads. This contributes to the opening action and reduces the likelihood of clashing between the neighboring suction heads. In other words, when a suction head approaches and attracts the respective layer L of the folded sheet B, it begins to move or already moves upwardly along its endless path and is disengaged from the respective layer L while it continues to move to a higher level or when it reaches the uppermost level of its endless path. Each suction head reaches the highest level after it advances beyond the associated retaining element 30.

Figure 2:
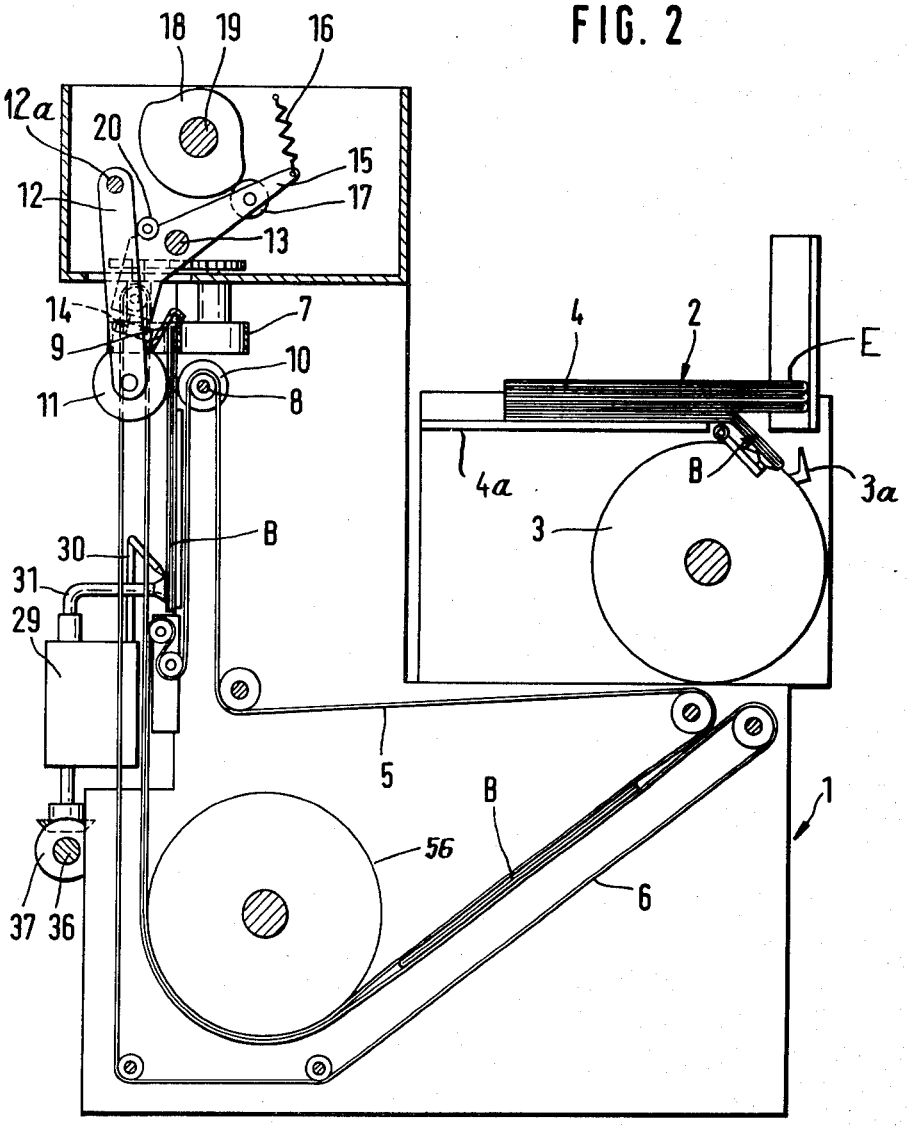
FIG. 2 is a sectional view as seen in the direction of arrows from the line II—II of FIG. 1.

When a folded sheet B enters the elongated path which is defined by the conveyors 21 and moves toward the saddle 35, the outermost layer L of its lefthand set of layers, as viewed in FIG. 2, is engaged by the first or foremost suction head 31 which flexes the lower front portion of such outermost layer away from the adjoining layer, and the extent of such flexing is sufficient to ensure that the inner side of the outwardly flexed outermost layer is engaged by the foremost retaining element 30 which then holds such layer against return movement toward its original position. The next-to-the outermost layer L is then engaged by the second suction head 32 whose angular position deviates from that of the foremost suction head 31, and the suction head 32 folds the lower front portion of the respective layer L outwardly and to the outer side of the associated retaining element 30 which engages the inner side of the outwardly flexed portion of the layer and thereby holds both layers (namely, the outermost and the next-to-the-outermost layer) against return movement to their original positions. The same mode of operation is resorted to for outward flexing of the third layer by the suction head 33, and the innermost layer L is flexed outwardly by the suction head 34. The four layers are held in outwardly flexed positions by the fourth or rearmost retaining element 30 for an interval of time which suffices to ensure that the folded sheet B is then caused to straddle the saddle 35 during further movement with the conveyors 21.

The inclination of the axes about which the suction heads 31 to 34 orbit is selected with a view to ensure that the distance between the locus where a layer L is attracted by the respective suction head and the conveyors 21 remains at least substantially unchanged while the respective suction head continues to attract the layer (and simultaneously travels along the corresponding endless path). This ensures that the outwardly flexed layer is not forcibly separated from the respective suction head 31, 32, 33 or 34 before it assumes an optimum position with reference to the corresponding retaining element 30. If the inclination of the axes about which the suction heads 31 to 34 orbit is selected in such a way that the just discussed distance decreases slightly, the layer which is being attracted by a suction head is caused to slide relative to the neighboring layer. This is often desirable because such sliding movement enhances the separation of neighboring layers L from one another and thus contributes to more reliable opening of the folded sheets B. This mode of selecting the inclination of the axes about which the suction heads orbit is desirable and advantageous if the layers L of the folded sheets B are thin or very thin.

The means for orbiting the suction heads 31 to 34 about the respective axes comprises a common horizontal main shaft 37 which transmits torque to the lower end portions of inverted L-shaped carriers 38 for the suction heads 31–34 by way of discrete bevel gear transmissions 37. The speed of the main shaft 36 and the ratios of the transmissions 37 are selected in such a way that the speed or orbital movement of each suction head along the respective endless path matches or approximates the speed of the conveyors 21.

If the transmission or transmissions between the timing shaft 19 and the conveyors 7, 21 are designed in such a way that the intermediate conveyor 7 is driven at a constant speed but the speed of the conveyors 21 varies cyclically between a maximum and a minimum value, the transmissions 37 are replaced with transmissions which drive the suction heads 31 to 34 in synchronism with the conveyors 21, i.e., in such a way that the speed of orbital movement of the suction heads varies at the same rate as the speed of movement of a folded sheet B whose edge portion E is held between the inner reaches of the conveyors 21.

The exact manner of connecting the suction heads 31 to 34 with a suction generating device 39 (e.g., a suction pump or a fan) forms no part of the invention. For example, the carriers 38 for the suction heads 31 to 34 can constitute tubular bodies each of which has a slot communicating with a groove 40 in the support 29 during that stage of orbital movement of each suction head when the latter attracts the respective layer L. The grooves 40 (only one shown in FIG. 1) are connected with the suction generating device 39 by flexible conduit means 41 to allow for adjustments of the level of the support 29 in response to rotation of the feed screws 28. Each suction head communicates with the suction generating device 39 during a relatively small portion of each of its orbits.

An important advantage of the improved apparatus is that it occupies little room and that it ensures predictable and reproducible opening or spreading of successive folded sheets B regardless of whether the conveyors 21 are driven at a low, high or very high speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for opening successive folded sheets each of which has two sets of layers pivotable with reference to one another along an edge portion of the respective folded sheet, comprising substantially horizontal sheet transporting conveyor means arranged to engage the edge portions of successive folded sheets so that the two sets of layers extend downwardly, and to advance the thus engaged folded sheets in a predetermined direction along an elongated path; a plurality of suction heads, one for each layer of a set, said suction heads being adjacent to one side of said path and being disposed one after the other, as considered in said direction, to engage successive layers of the one set forming part of a folded sheet advancing along said path; and a plurality of retaining elements, one for each of said suction heads and each disposed downstream of the respective suction head, as considered in said direction, to maintain the respective layer of the one set in opened position and to thus enable the next-following suction head to reach the corresponding layer of the one set.

2. The apparatus of claim 1, further comprising means for orbiting said suction heads about discrete axes so that each suction head orbits along an endless path a portion of which is adjacent to said one side of said elongated path, a suction generating device, and means for connecting said suction heads with said suction generating device while the respective suction heads advance along said portions of their endless paths.

3. The apparatus of claim 2, wherein said axes are inclined to the vertical and the suction heads which orbit along said portions of their respective paths move from a lower level to a higher level.

4. The apparatus of claim 1, further comprising second conveyor means at least substantially aligned with and located upstream of said sheet transporting conveyor means, as considered in said direction, to deliver successive folded sheets into the range of said transporting conveyor means, and means for supplying folded sheets to said second conveyor means including third conveyor means defining an upwardly extending path and arranged to deliver successive folded sheets to said second conveyor means so that said edge portions are located at the upper ends of folded sheets in said upwardly extending path.

5. The apparatus of claim 4, further comprising an aligning device adjacent to said second conveyor means and arranged to engage and orient the edge portions of successive folded sheets which are supplied by said third conveyor means.

6. The apparatus of claim 5, further comprising means for yieldably biasing successive folded sheets against said second conveyor means during advancement of such folded sheets with said second conveyor means and into the range of said transporting conveyor means.

7. The apparatus of claim 6, wherein said biasing means comprises at least one rotary element and means for urging the rotary element against the folded sheet which is adjacent to said second conveyor means.

8. The apparatus of claim 4, further comprising means for driving one of said transporting and second conveyor means at a periodically varying speed and for driving the other of said transporting and second conveyor means at a speed which matches the speed of said one conveyor means during transfer of folded sheets from said second to said transporting conveyor means.

9. The apparatus of claim 8, wherein said one conveyor means is said transporting conveyor means.

10. The apparatus of claim 9, further comprising means for orbiting said suction heads about discrete axes so that each suction head orbits along an endless path a portion of which is adjacent to said one side of said elongated path, a suction generating device, and means for connecting said suction heads with said suction generating device while the respective suction heads advance along said portions of their endless paths, said orbiting means including means for varying the speed of angular movement of said suction heads in synchronism with the periodically varying speed of said transporting conveyor means.

11. The apparatus of claim 10, wherein said driving means includes means for varying the speed of said transporting conveyor means between a maximum value and a minimum value and further comprising means for yieldably biasing successive folded sheets against said second conveyor means while said transporting conveyor means is driven at said minimum speed.

12. The apparatus of claim 1, further comprising a common support for said suction heads and said retaining elements.

13. The apparatus of claim 12, further comprising means for adjusting the level of said support.

14. The apparatus of claim 1, wherein said transporting conveyor means comprises two endless flexible elements defining an elongated gap wherein the edge portions of successive folded sheets are advanced along said path.

15. The apparatus of claim 1, further comprising a substantially wedge-like member for reception of opened folded sheets downstream of said elongated path.

16. The apparatus of claim 1, wherein said suction heads are arranged to orbit about discrete parallel axes and successive suction heads are angularly offset with reference to one another.

17. The apparatus of claim 16, further comprising common drive means for rotating said suction heads about the respective axes.

* * * * *